US007448773B2

(12) United States Patent
Lai

(10) Patent No.: US 7,448,773 B2
(45) Date of Patent: Nov. 11, 2008

(54) DECORATIVE STRUCTURE

(76) Inventor: Chi-Shih Lai, 1F., No. 91, Lane 259, Szu Wei Rd., Panchiao, Taipei Hsien (TW)

( * ) Notice: Subject to any disclaimer, the term of this patent is extended or adjusted under 35 U.S.C. 154(b) by 26 days.

(21) Appl. No.: 11/705,092

(22) Filed: Feb. 12, 2007

(65) Prior Publication Data

US 2008/0192488 A1 Aug. 14, 2008

(51) Int. Cl.
*F21V 29/00* (2006.01)

(52) U.S. Cl. ..... 362/264; 362/162; 362/196; 362/654; 248/461

(58) Field of Classification Search ..... 362/362, 362/162, 196, 250, 654; 248/461
See application file for complete search history.

(56) References Cited

U.S. PATENT DOCUMENTS 3,873,880 A * 3/1975 Riddell ..... 315/53
4,425,602 A * 1/1984 Lansing ..... 362/186
5,410,460 A * 4/1995 Liou ..... 362/250
5,772,312 A * 6/1998 Pihl-Niederman et al. .. 362/249
6,299,332 B1 * 10/2001 Huang ..... 362/363
2006/0274533 A1 * 12/2006 Richmond et al. ..... 362/311

* cited by examiner

*Primary Examiner*—Evan Dzierzynski
(74) *Attorney, Agent, or Firm*—Rosenberg, Klein & Lee

(57) ABSTRACT

A decorative structure includes at least one hollow modeling shell and at least one limiting ring. The modeling shell is assembled by two corresponding half bodies. An outside of one half body corresponds to an inside of the other half body thereby the two half bodies are positioned in the same direction. The modeling shell has at least one connecting portion along jointed ends of the two half bodies. The limiting ring surrounds an outside of the connecting portion for supporting the modeling shell. Accordingly, the present invention positions the two half bodies in the same direction so that the modeling shell is positioned before being assembled to reduce its volume.

9 Claims, 15 Drawing Sheets

DECORATIVE STRUCTURE

BACKGROUND OF THE INVENTION

1. Field of the Invention

The present invention relates to a decorative structure, and more especially to a decorative structure of which two half bodies of a modeling shell can be positioned in the same direction to reduce the volume of the unassembled decoration when being transported and stored.

2. Description of the Prior Art

As people pay greater attention to their living standards, they like to create living atmospheres in places they inhabit for any length of time. To decorate interior spaces with a variety of decorations not only fills the space, but also adds joy to their lives, thereby improving humdrum interior environments and creating pleasant atmospheres. Especially during festivals, such as Thanksgiving, All Saints' Day, Christmas and so on, decorating interior spaces is a western custom that creates warm atmospheres and adds to the festive nature of the celebration.

However, as globalization continues to expand and the international division of labor deepens, the places where decorations are manufactured are usually far away from the places where the decorations are sold and used. Usually the decorations are manufactured in a country and sold or used in another country. For example, products manufactured in China or South East Asian are often sold in America, Canada or Europe. As such, the manufactured decorations usually need to be transported by sea, by air or by land to arrive in the places they are to be sold or used. Because decorations are usually large in volume and irregular in shape (such as decorations with extended arms or bended long tails), packaging costs and transportation costs are quite high.

To reduce the costs of packaging and transportation, manufacturers often separate a decoration into a plurality of elements and then repackage the elements in a new packaging arrangement to reduce the packaging volume and save on packaging material. Furthermore, because reduction of a single packaging volume can increase the total quantity of the decorations stored in the same container, efficiency of transportation can be improved and the costs of packaging and transportation can be further reduced.

Although the decorations described above can be separated into a plurality of elements to be packaged in order to reduce packaging volume and increase the total transportation quantity of containers, the decorations have shortcomings as described below:

1. The above prior decorations can be separated into a plurality of elements to be packaged. However, each element still has a basic volume and occupies a basic space, so no matter how many elements the decoration can be separated into or how many packaging arrangement modes are projected, the efficacy that the volume is reduced is only achieved by increasing packaging density, meanwhile the actual total volume is unchanged. Hence, this way only partly achieves the efficacy of reducing packaging materials; the packaging costs cannot be further substantially reduced. The most common packaging material is paper. As costs of raw material rise and environmental protection consciousness improves, packaging costs will only continue to rise.

2. No matter how many elements the above prior decorations can be separated into, or how many packaging arrangement modes are projected, through the packaging volume is reduced, the actual total volume of decorations is unchanged so that the total quantity of the decorations stored in a same container cannot be substantially increased. Because energy costs in the international market are too high, if the total transportation quantity per unit container cannot increase, transportation costs will increase, which makes the decorations less competitive.

3. In cities, conventional families have limited living spaces, so storage space is reduced greatly. Since the actual total volume of the above prior decorations are unchanged after the decorations are separated into a plurality of elements to be stored, the decorations still occupy limited interior space. So how to reduce the storage volume of the decorations is a considerable problem for users.

Hence, the inventors of the present invention believe that the shortcomings described above are able to be improved upon and suggest the present invention as being of a reasonable design and as an effective improvement based on deep research and thought.

SUMMARY OF THE INVENTION

An object of the present invention is to provide a decorative structure, of which two half bodies of a modeling shell can be positioned in the same direction to reduce volume of the unassembled decoration for transportation and storage.

To achieve the above-mentioned object, a decorative structure in accordance with the present invention is disclosed. The decorative structure includes at least one hollow modeling shell assembled by two corresponding half bodies, wherein an outside of one half body corresponds to an inside of the other half body thereby the two half bodies are positioned in the same direction, the modeling shell having at least one connecting portion along jointed ends of the two half bodies; and at least one limiting ring surrounding an outside of the connecting portion for supporting the modeling shell.

Accordingly, the present invention positions the two half bodies in the same direction thereby the modeling shell arranged so that one half body is disposed upon the other half body before being assembled in order to reduce the whole volume.

To further understand technical contents, methods and efficacy of the present invention, please refer to the following detailed description and drawings related the present invention. It is believed that the objects, features and points of the present invention can be deeply understood. However, the drawings are only to be used as references and explanations, not to limit the present invention.

DETAILED DESCRIPTION OF THE INVENTION

Figure 1:
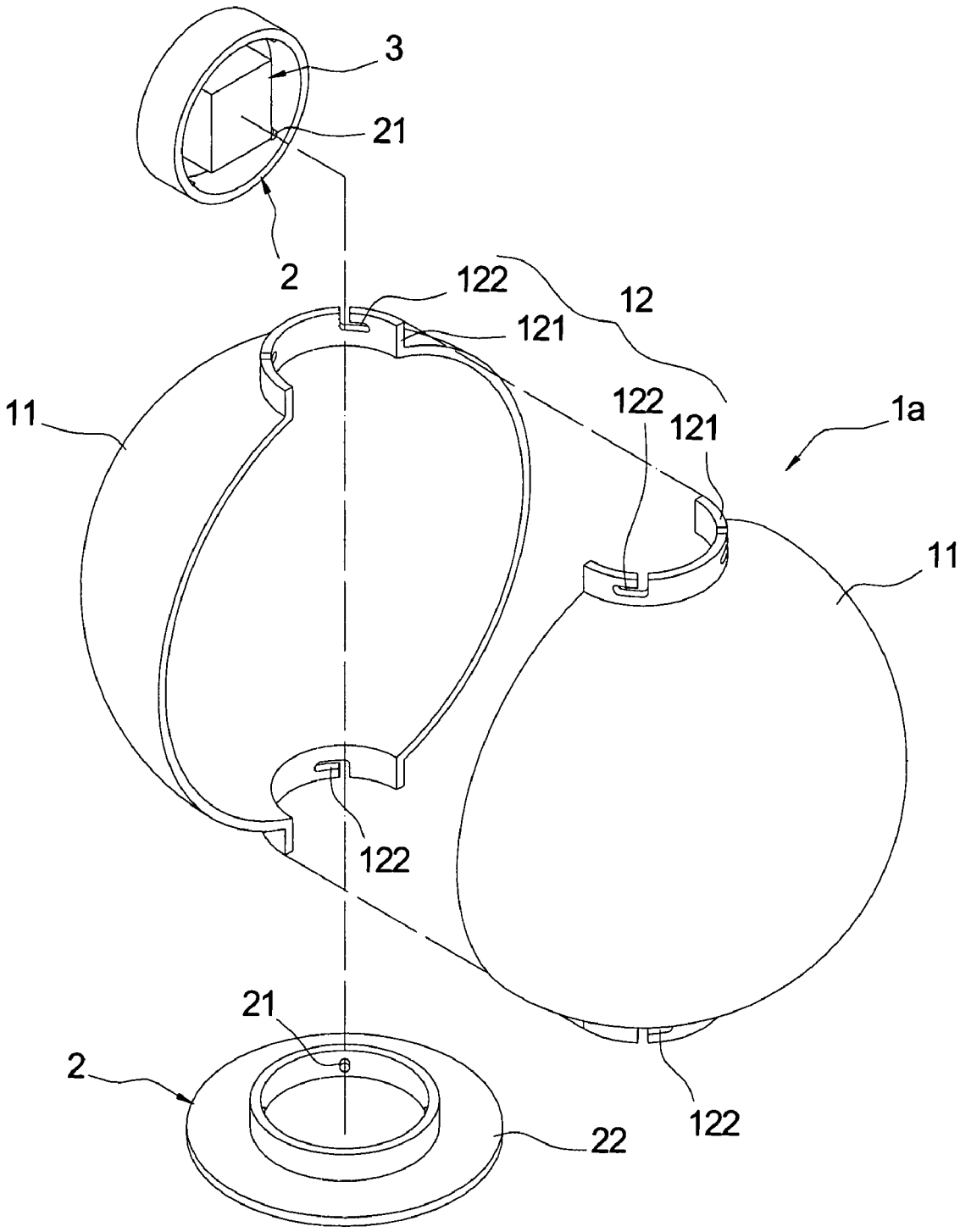
FIG. 1 is an exploded perspective view of a decorative structure in accordance with the present invention.
Figure 2:
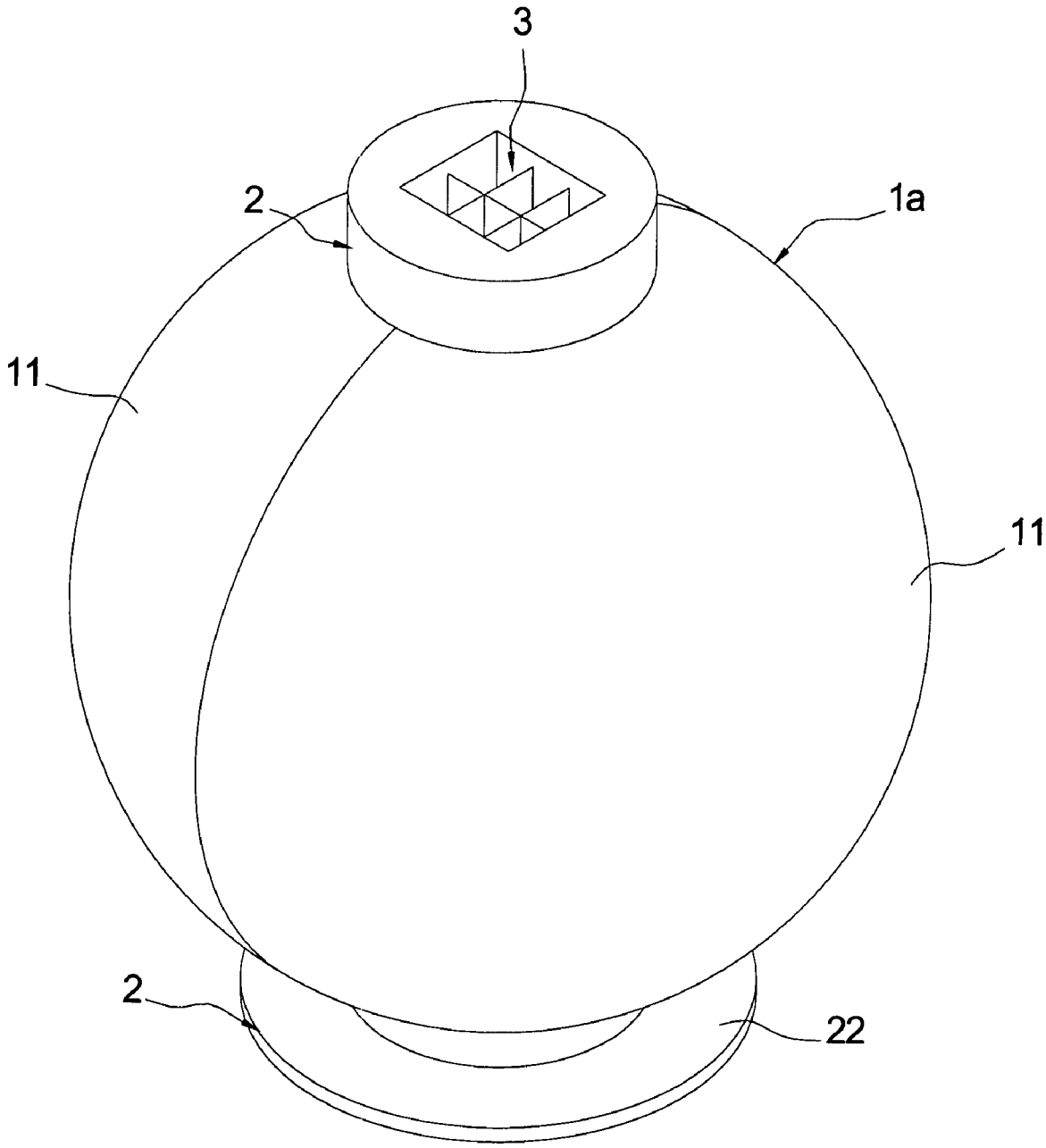
FIG. 2 is an assembled perspective view of the decorative structure in accordance with the present invention.
Figure 3:
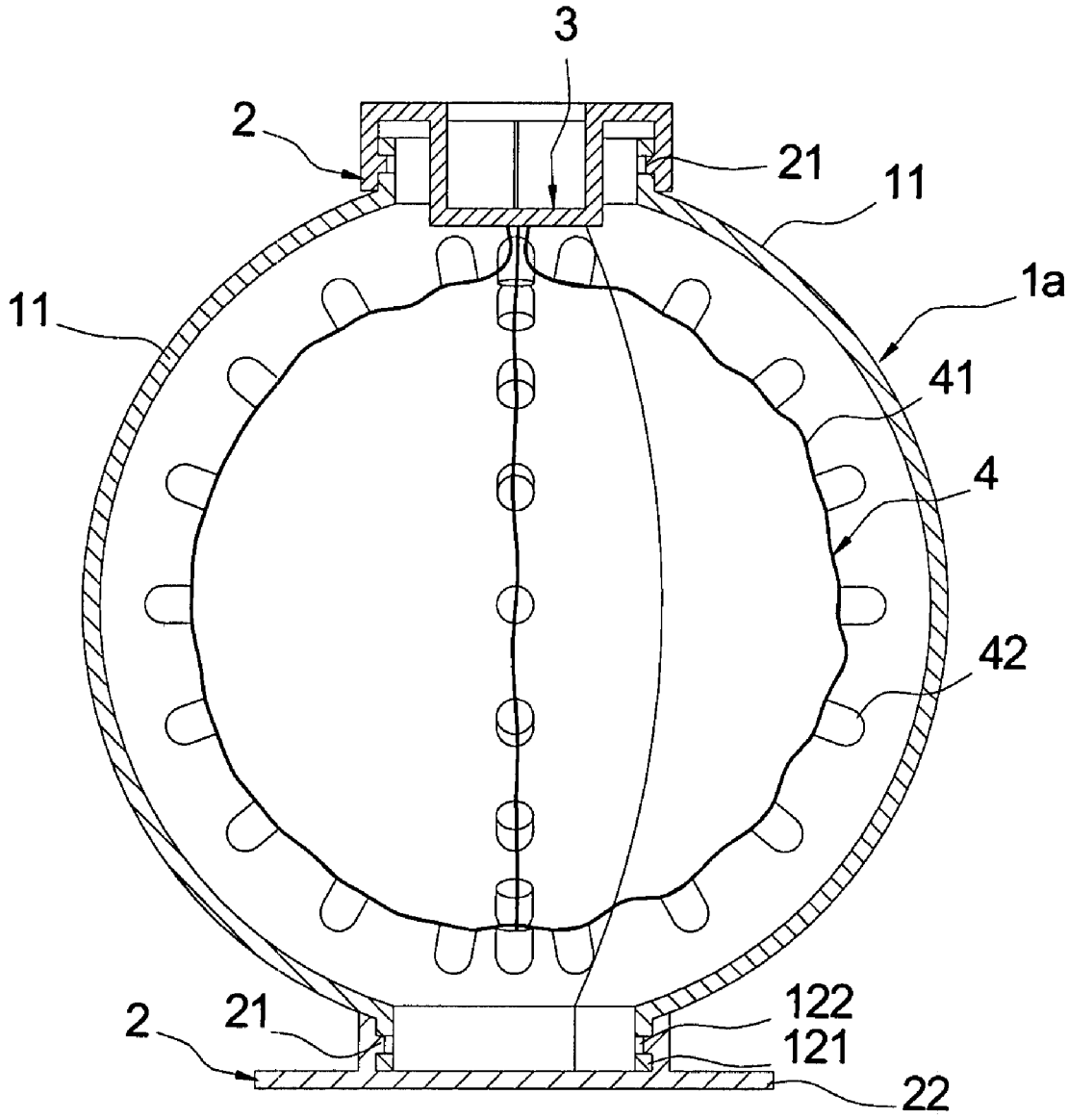
FIG. 3 is a sectional view of the decorative structure in accordance with the present invention.
Figure 4:
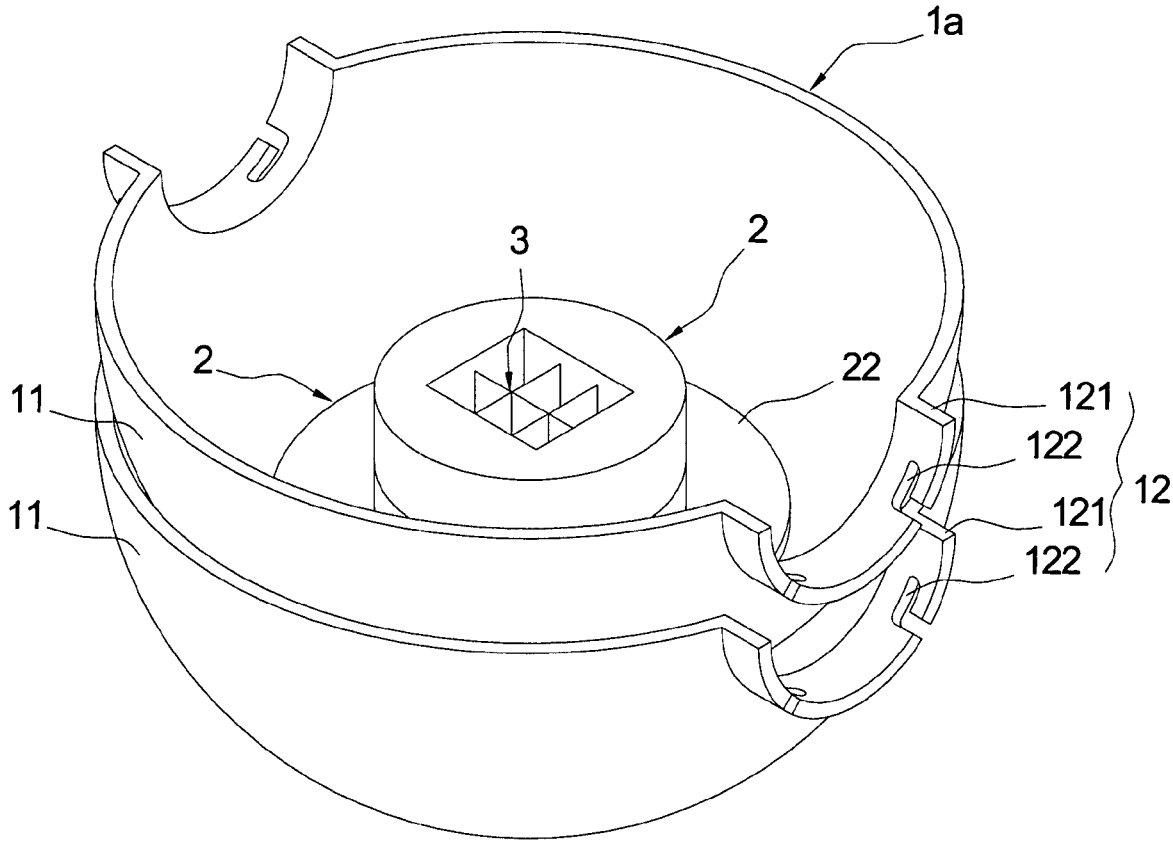
FIG. 4 is a perspective view of the decorative structure in accordance with the present invention, in a positioned state.
Figure 5:
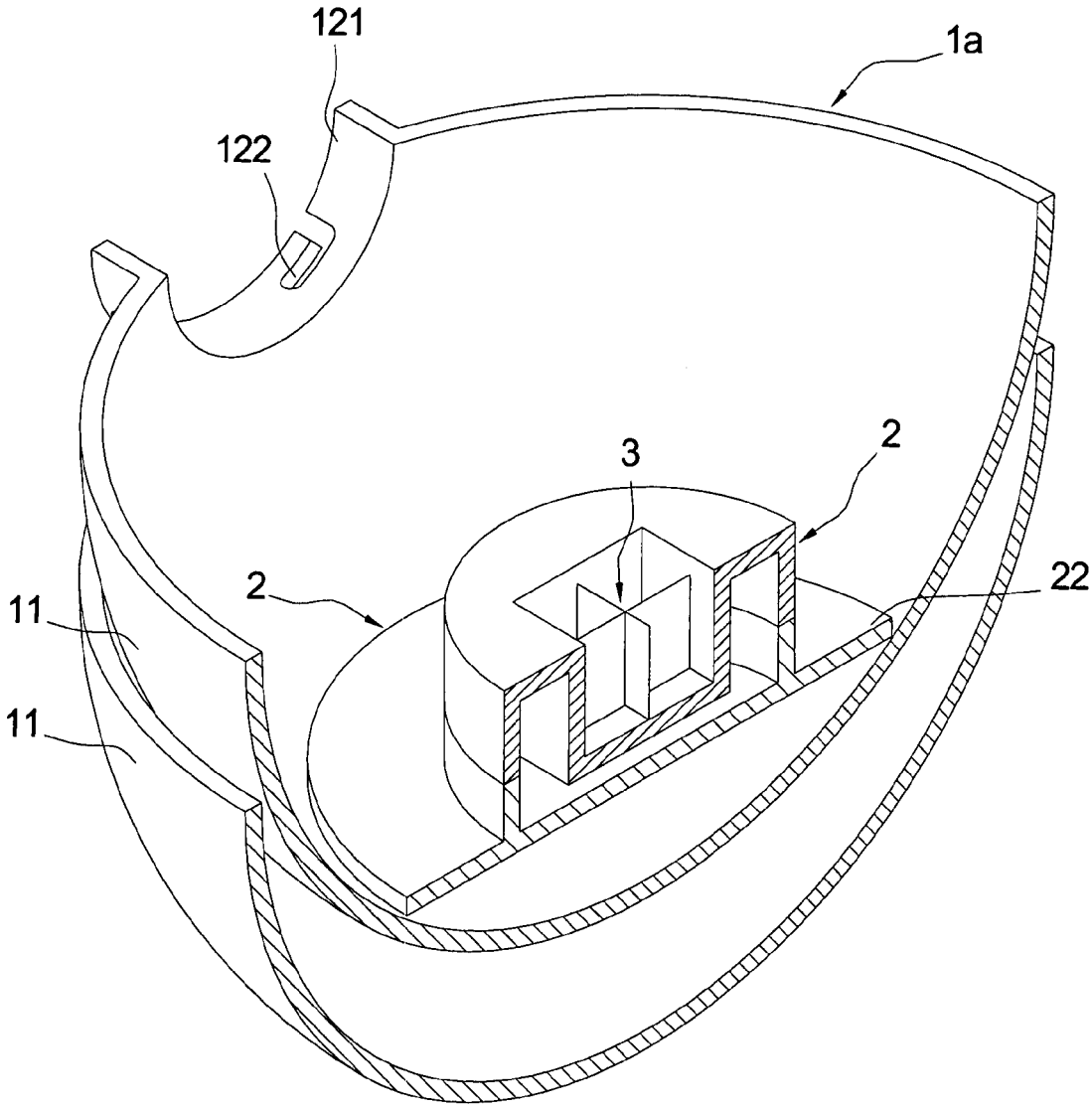
FIG. 5 is a sectional view of the decorative structure in accordance with the present invention, in a positioned state.
Figure 6:
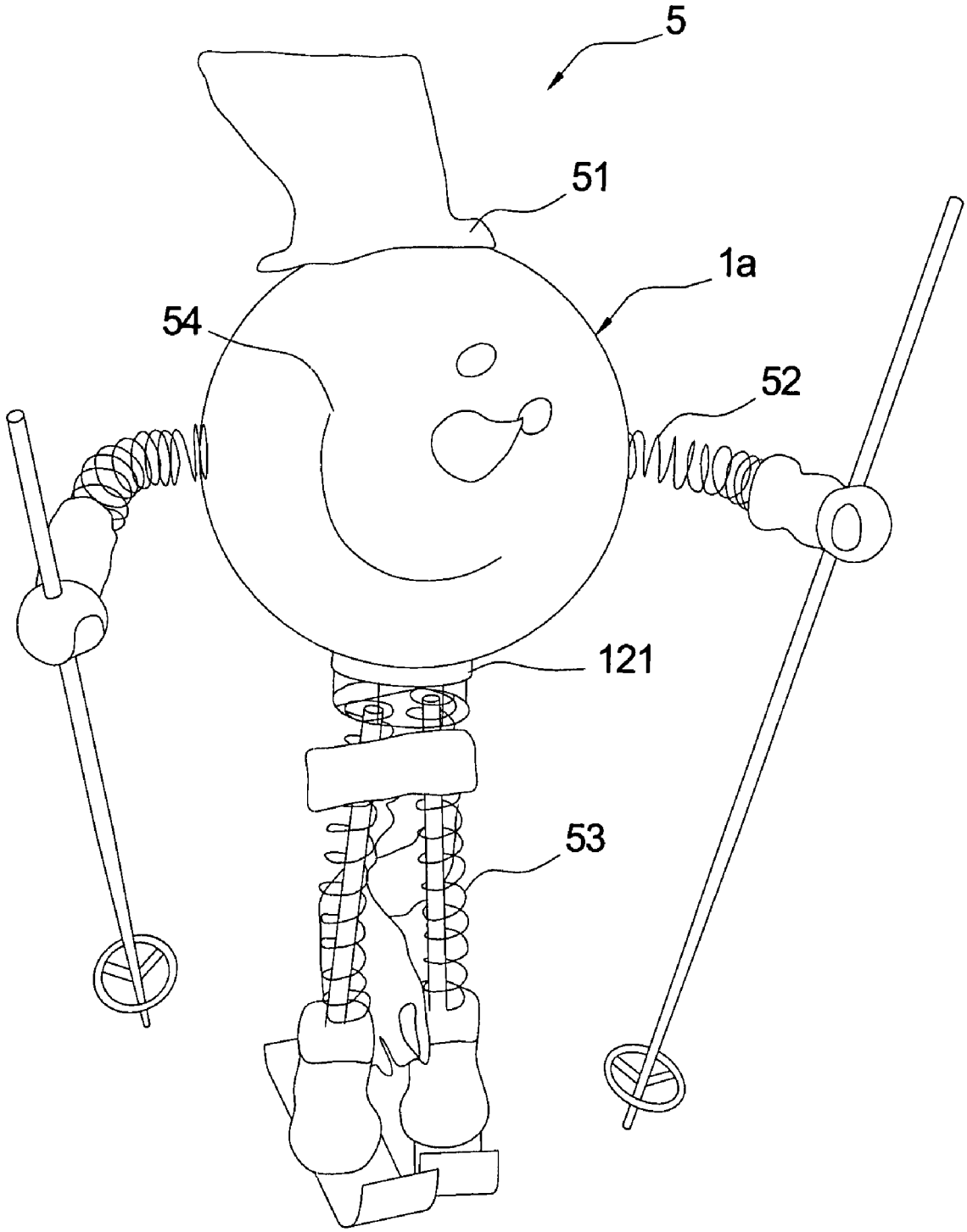
FIG. 6 is a perspective view of the decorative structure in accordance with the present invention, combined with modeling fittings.
Figure 7:
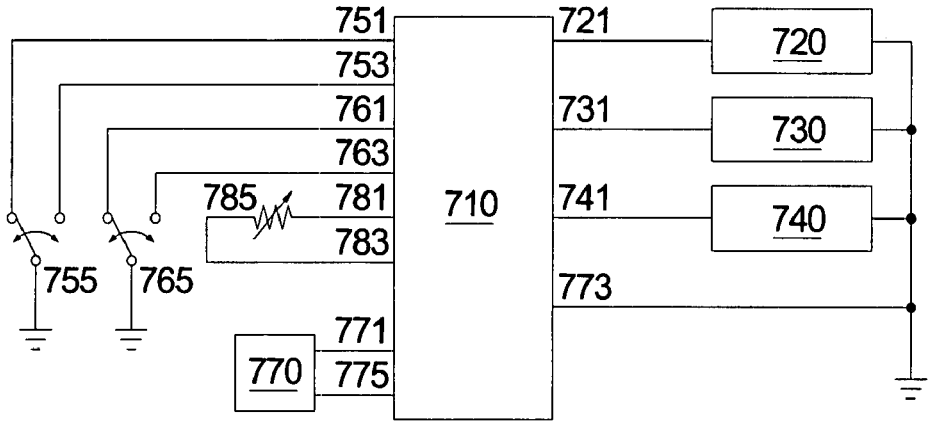
FIG. 7 is a block diagram of a controlling device of the decorative structure in accordance with the present invention.

Please referring to FIGS. 1-6 in which a decorative structure in accordance with a preferred embodiment of the present invention is shown. The decorative structure includes a hollow first modeling shell 1*a,* two limiting rings 2, a glowing assembly 4, and a plurality of modeling fitting units 5.

The first modeling shell 1*a* is formed via two corresponding and symmetrical half bodies 11 engaging with each other. An outside of one half body 11 corresponds to an inside of the other half body 11 so that the two half bodies 11 can be positioned in a same direction. The first modeling shell l*a* has two connecting portions 12 respectively along two jointed ends of a diameter of the two half bodies 11. Each connecting portion 12 has two corresponding arc-shaped pieces 121 disposed respectively on same jointed ends of the two half bodies 11 of the modeling shell 1*a*. The two arc-shaped pieces 121 of each connecting portion 12 has two fastening holes 122 in side flanges.

The two limiting rings 2 surround outsides of the two connecting portions 12 of the first modeling shell 1*a,* respectively. Two first locating blocks 21 protrude from an inner side of each limiting ring 2. The first locating blocks 21 are protruding blocks corresponding to the fastening holes 122 and can engage with the corresponding fastening holes 122 to fix the limiting rings 2 for supporting the first modeling shell 1*a*. One of the limiting rings 2 has a base 22 fixed on a bottom to support the first modeling shell 1*a,* the other limiting ring 2 has a controlling device 3 fixed on an end and can be received in an inner side of one of the half bodies.

The modeling fitting units 5 have a cap modeling fitting unit 51, two upper limb modeling fitting units 52, two lower limb modeling fitting units 53, and a plurality of expression modeling fitting units 54, which are respectively fixed around the first modeling shell 1*a* thereby to form a modeling decoration of which a main body is the first modeling shell 1*a*. The two upper limb modeling fitting units 52 and the two lower limb modeling fitting units 53 respectively consist of elastic units (such as springs, elastic pieces, and so on) or tubular elements (not shown).

The modeling decoration has the glowing assembly 4 attached to and spreading along an inside of the first modeling shell 1*a* to achieve a glowing effect and adding to an atmosphere of a decorated space. The glowing assembly 4 has a plurality of flexibility wires 41 which electrically connect in series. One end of one flexibility wire 41 electrically connects to the controlling device 3. A plurality of glowing elements 42 is mounted along the flexibility wires 41. The glowing elements 42 can be LED lights, light bulbs, etc.

Please refer to FIGS. 1-6. When assembled, two half bodies 11 of the first modeling shell 1*a* engage with each other in a same direction. The connecting portions 12 of two ends of the first modeling shell 1*a* are sleeved and fixed by the limiting rings 2 to form the first modeling shell 1*a*. The first modeling shell 1*a* matches the modeling fitting unit 5 and the controlling device 3 controls the glowing elements 42 of the glowing assembly 4 to glow, thereby providing changeable transmission lights for creating atmosphere in a decorated space. During packaging, transportation and storage, the two half bodies of the first modeling shell 1*a* can be positioned in the same direction and receive the limiting rings 2 inside to reduce their volume.

Since the glowing assembly of the present invention has lamps with changeable lamplights, the present invention further provides a control circuit to control the controlling device 3 of the glowing assembly 4 to describe operation of the LED glowing elements 42.

The control circuit which controls the controlling device 3 includes a control chip 710, a red light group 720, a blue light group 730, a green light group 740, a power supply 770, and a variable resistor 785 for controlling an action-time of the circuit. The power supply 770 provides a DC (direct current) source via a pin 771, and provides an AC (alternating current) source for the control chip 710 via a pin 775 so that the control chip 710 can further control run-sequences and glowing actions of the red light group 720, the blue light group 730, and the green light group 740, and connect to the ground via a pin 773.

The control chip 710 controls the red light group 720 via a pin 721, controls the blue light group 730 via a pin 731 and controls the green light group 740 via a pin 741. The other ends of the red light group 720, the blue light group 730, and the green light group 740 connect to the ground.

The control chip 710 further provides pins 751, 753 as controlling switch points, thereby users switch running circuits of the LED glowing elements 42 by switching a first switch 755, the color of the LED glowing elements 42 is changed. The embodiment has two or three color changes. In other words, when the first switch 755 switches to the pin 751, the control chip 710 will control two groups of the red light group 720, the blue light group 730, and the green light group 740 to change and the other group remains unchanged.

The control chip 710 can control the brightness of the LED 42 glowing elements by switching the connection of the pins 761, 763 via a second switch 765. For example, assuming that the pin 761 controls the red light group 720, the blue light group 730 or the green light group 740 to twinkle alternately and continuously, then the pin 763 controls the red light group 720, the blue light group 730 or the green light group 740 to gradually brighten or dim. When the second switch 765 switches to the pin 761 so that the pin 761 connects to the ground, under the control of the control chip 710, the red light group 720, the blue light group 730 or the green light group 740 twinkle alternately and continuously. When the second switch 765 switches to the pin 763 so that the pin 763 connects to the ground, under the control of the control chip 710, the red light group 720, the blue light group 730 or the green light group 740, gradually changes brighter or dimmer.

Because a variable resistor 785 connects to pins 781, 783, the control chip 710 can control the action-time of the red light group 720, the blue light group 730 or the green light group 740 according to the variety of the variable resistor 785.

Figure 8:
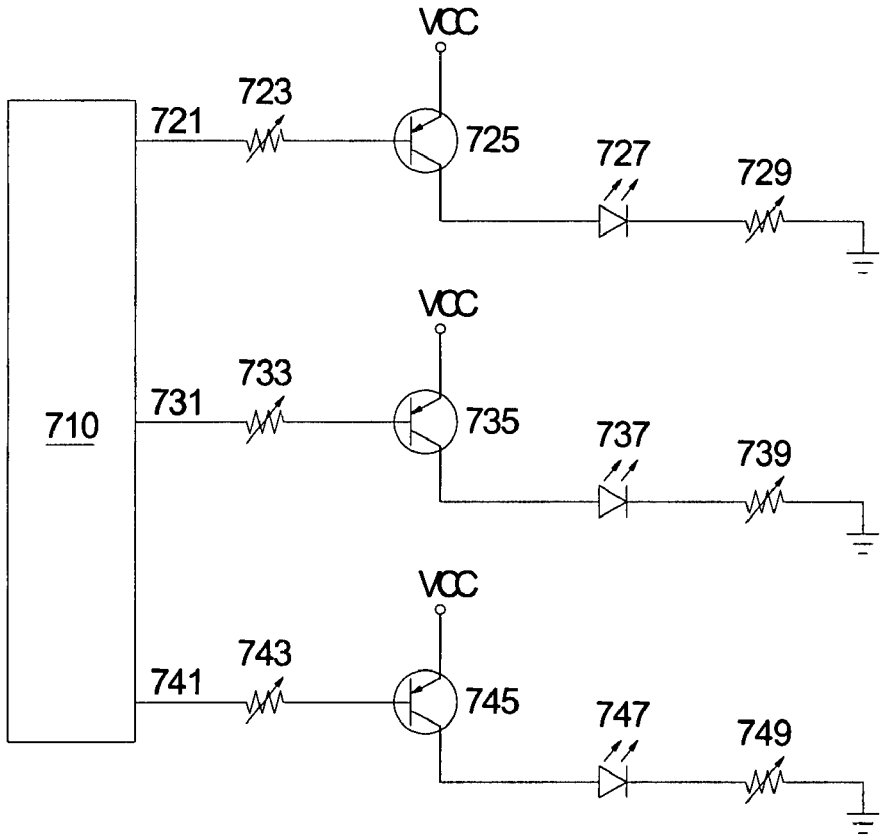
FIG. 8 is a circuit wiring diagram of the controlling device and glowing elements of the decorative structure in accordance with the present invention.

Control circuitries in the red light group 720, the blue light group 730 or the green light group 740 are shown in FIG. 8.

The red light group 720 includes variable resistors 723, 729, a control transistor 725, and a red LED light 727. The blue light group 730 includes variable resistors 733, 739, a control transistor 735, and a blue LED light 737. The green light group 740 includes variable resistors 743, 749, a control transistor 745, and a green LED light 747.

Assuming that the first switch 755 switches to the pin 751 so that the pin 751 connects to the ground, the control chip 710 controls the red light group 720, the blue light group 730, and the green light group 740 to work. Accordingly, when the control transistor 725 connects to a certain voltage source VCC, the control chip 710 can transmit signals to the control transistor 725 via the pin 721 to ensure that the control transistor 725 conducts and further makes the red LED light 727 conduct. Switch directions of the first switch 755 can be predetermined.

In the same way, the control chip 710 can transmit signals to the control transistor 735 via the pin 731 to ensure that the control transistor 735 conducts and further makes the blue LED light 737 conduct. Alternatively, the control chip 710 can transmit signals to the control transistor 745 via the pin 741 to ensure that the control transistor 745 conducts and further makes the green LED light 747 conduct.

The action-time of each LED light is determined by a variable resistor 785 and action changes of each LED light are controlled based upon the switching of the second switch 765.

Figure 9:
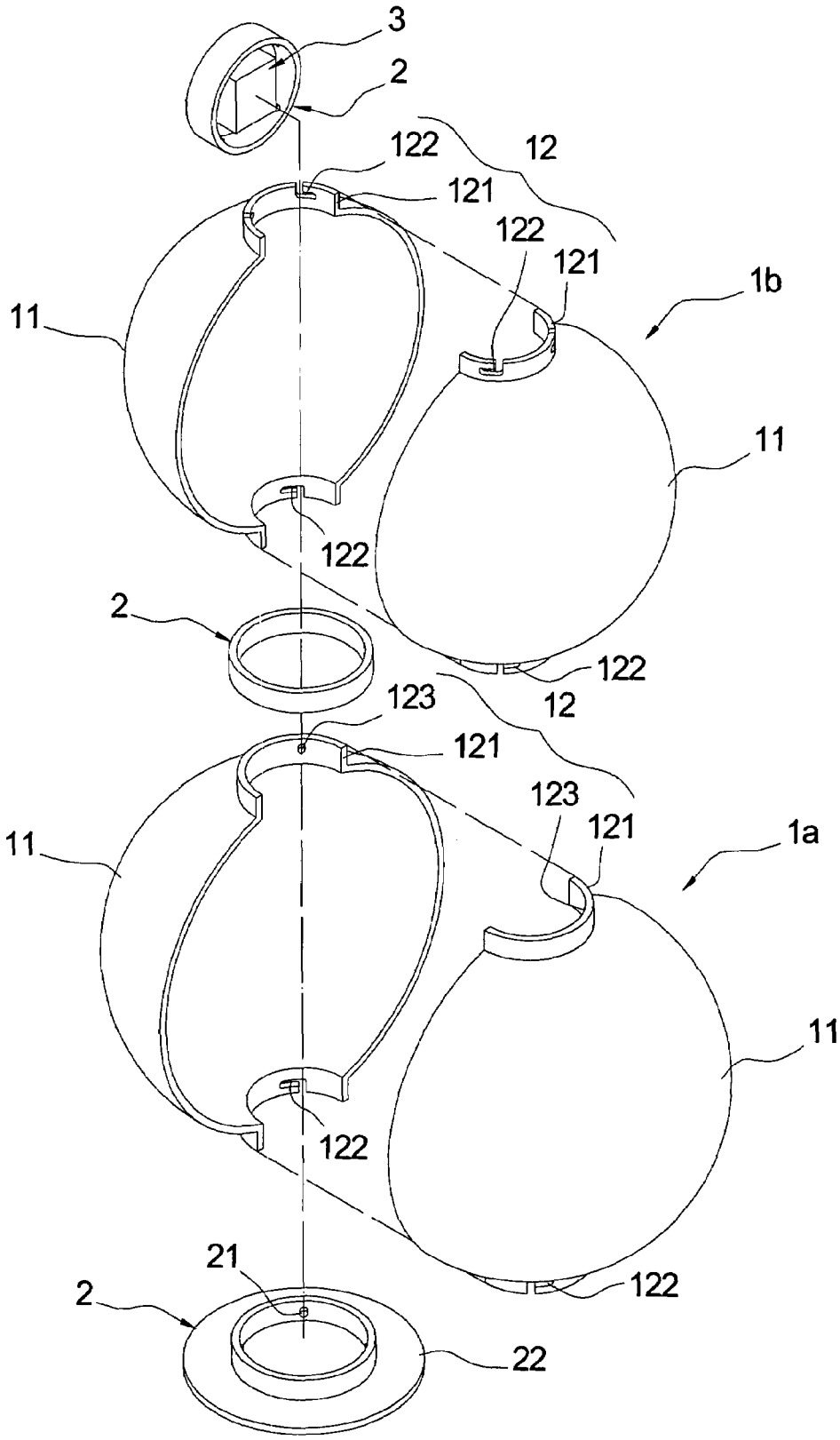
FIG. 9 is an exploded perspective view of a second embodiment of the decorative structure in accordance with the present invention.
Figure 10:
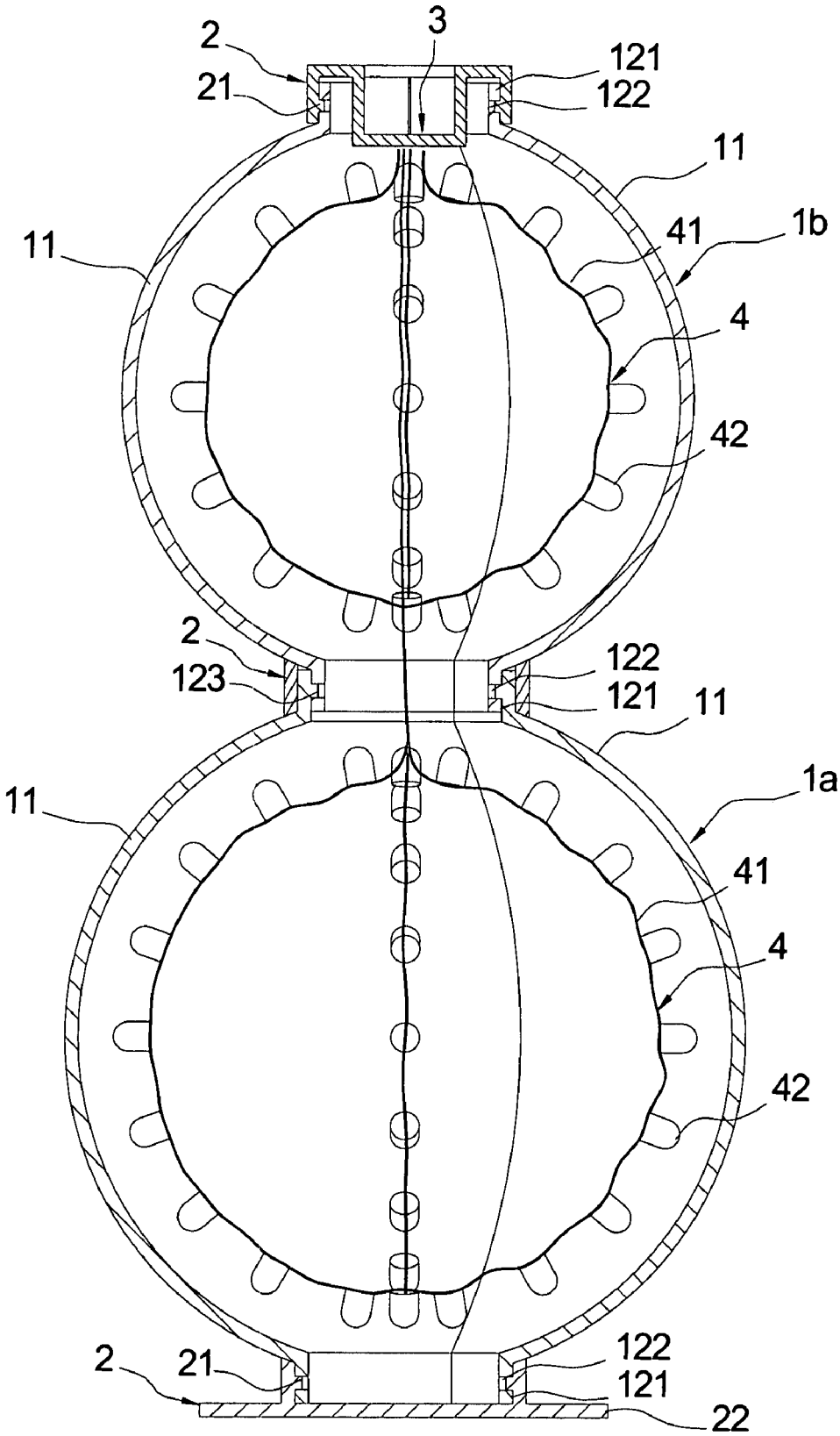
FIG. 10 is a sectional view of the second embodiment of the decorative structure in accordance with the present invention.
Figure 11:
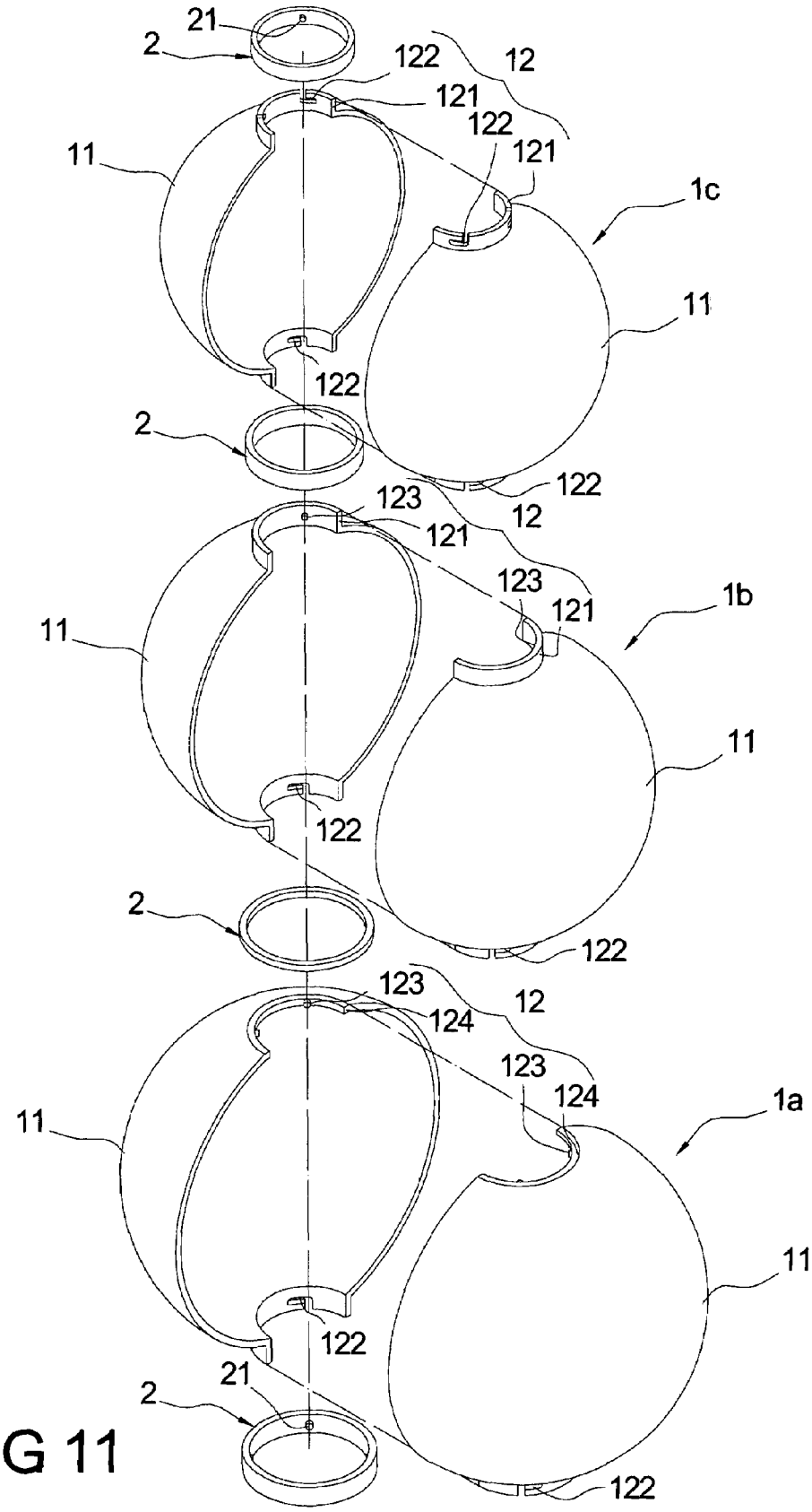
FIG. 11 is an exploded perspective view of a third embodiment of the decorative structure in accordance with the present invention.
Figure 12:
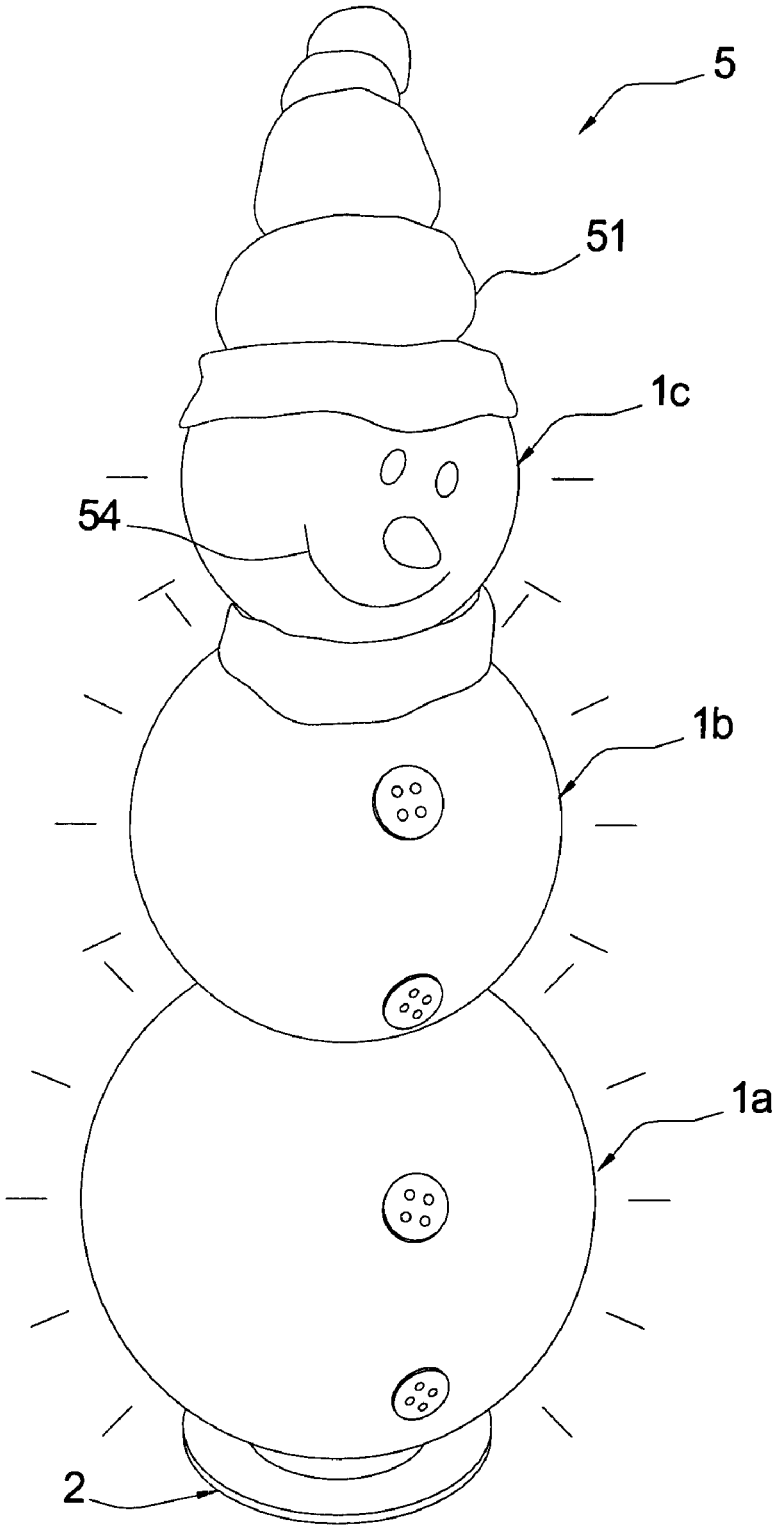
FIG. 12 is a perspective view of the third embodiment of the decorative structure in accordance with the present invention, combined with modeling fittings.
Figure 13:
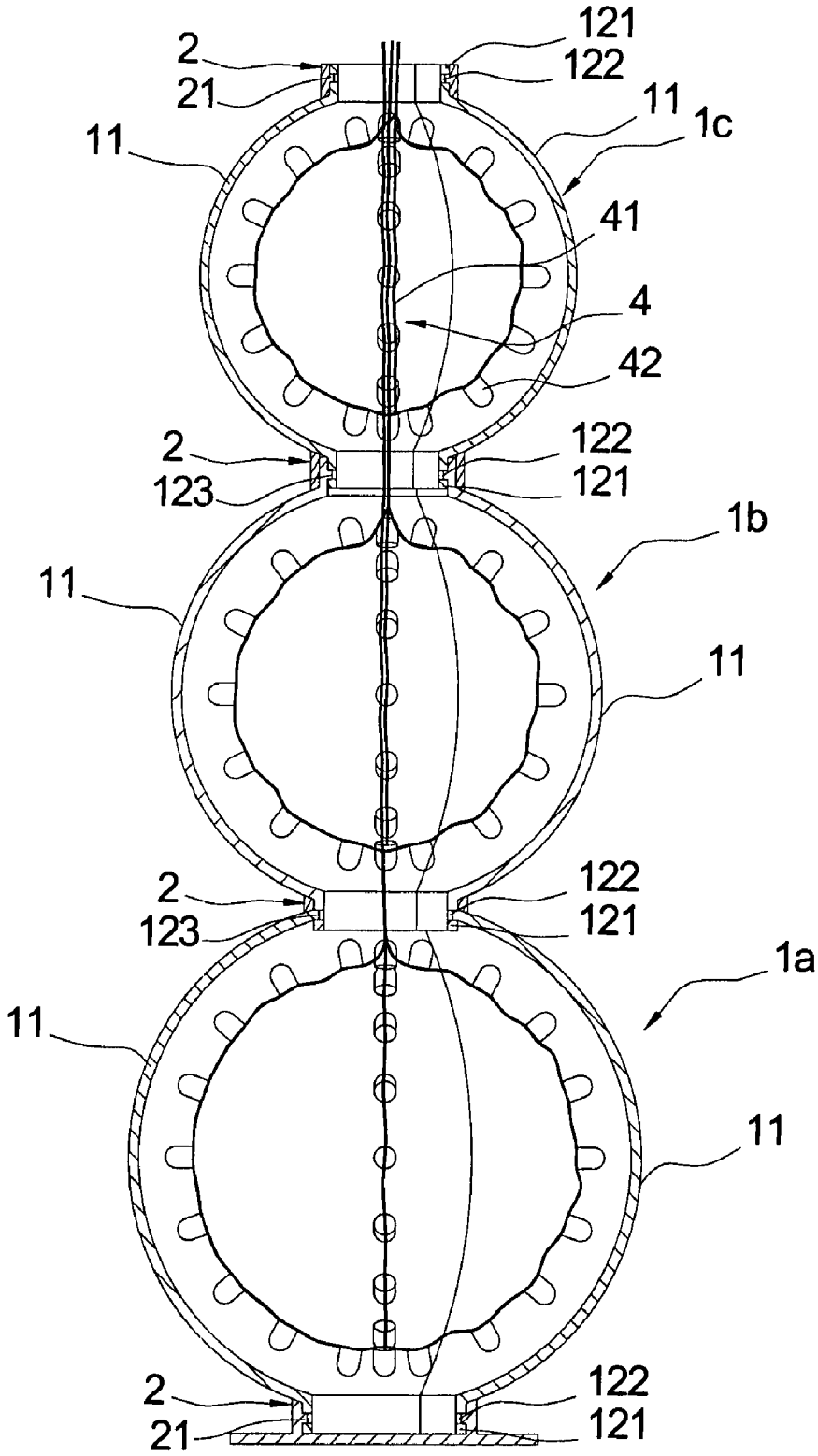
FIG. 13 is a sectional view of the third embodiment of the decorative structure in accordance with the present invention.
Figure 14:
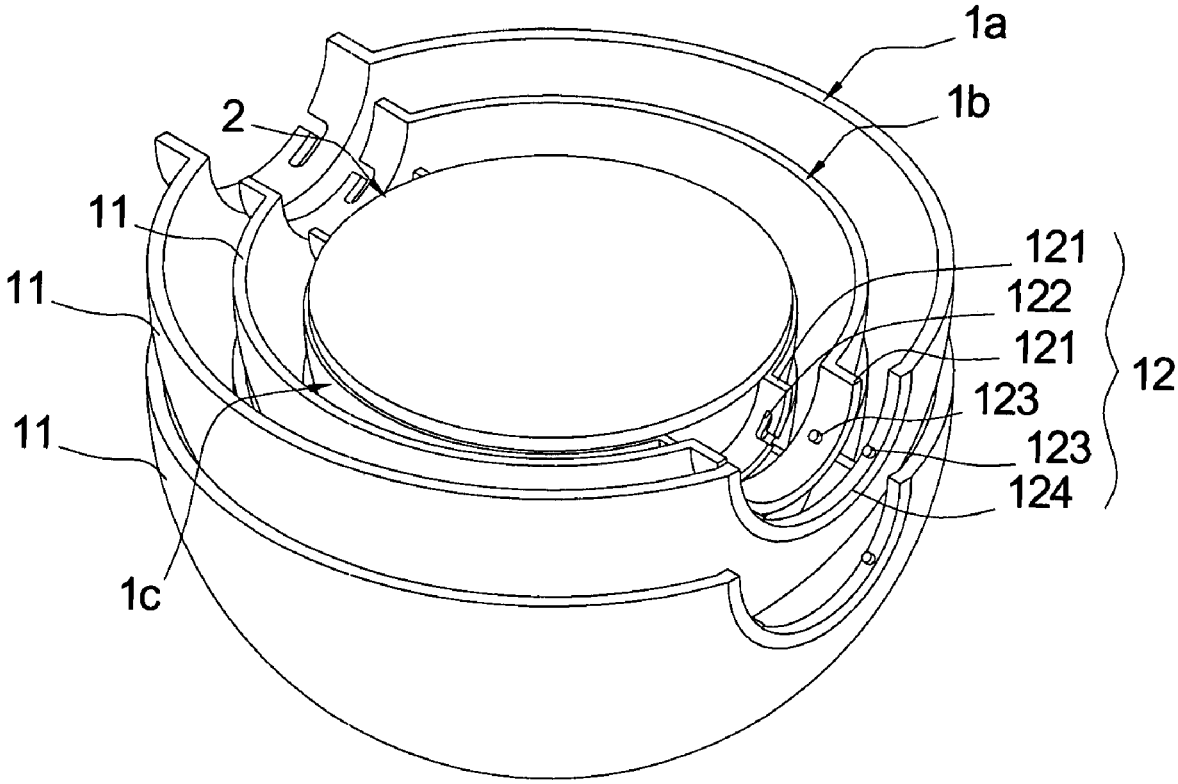
FIG. 14 is a perspective view of the third embodiment of the decorative structure in accordance with the present invention, in a positioned state.

A second embodiment of the present invention, as shown in FIG. 9 and FIG. 10, in the above structure, includes the first modeling shell 1*a* and a second modeling shell 1*b* which can be a same size or different sizes. One connecting portion 12 of the first modeling shell 1*a* is sleeved by and connected with a connecting portion 12 of the second modeling shell 1*b*. The connecting portion 12 of the first modeling shell 1*a* has at least one second locating block 123 on an inner flange, which engages with at least one fastening hole 122 of the second modeling shell 1*b* to connect the first modeling shell 1*a* with the second modeling shell 1*b*. The first modeling shell 1*a* and the second modeling shell 1*b* are fixed via the limiting ring 2 surrounding a periphery of the connecting portions 12 by which the first modeling shell 1*a* and the second modeling shell 1*b* connect with each other. The outside of each half body 11 of the first modeling shell 1*a* and the second modeling shell 1*b* correspond to the inside of the other half body 11 so that all the half bodies 11 can be positioned in the same direction. All the half bodies 11 of the first modeling shell 1*a* and the second modeling shell 1*b* can be positioned and receive each other in turn from large sizes to small sizes.

A third embodiment of the present invention, as shown in FIGS. 11-14, in the above structures, includes the first modeling shell 1*a*, the second modeling shell 1*b*, and a third modeling shell 1*c* which are a same size or different sizes. One connecting portion 12 of the first modeling shell 1*a* arranges corresponding openings 124 on the jointed ends of the two half bodies 11, respectively, to be properly sleeved by one connecting portion 12 of the second modeling shell 1*b*. The other connecting portion 12 of the second modeling shell 1*b* is properly sleeved by one connecting portion 12 of the third modeling shell 1*c*.

One of the connecting portions 12 of the first modeling shell 1*a* has at least one second locating block 123 on an inner flange, which engages with at least one fastening hole 122 of the second modeling shell 1*b* to connect the first modeling shell 1*a* with the second modeling shell 1*b*. The first modeling shell 1*a* and the second modeling shell 1*b* are fixed via the limiting ring 2 surrounding a periphery of the connecting portions 12 by which the first modeling shell 1*a* and the second modeling shell 1*b* connect with each other.

The other connecting portion 12 of the second modeling shell 1*b* has at least one second locating block 123 on an inner flange and engages with at least one fastening hole 122 of the third modeling shell 1*c* to connect the second modeling shell 1*b* with the third modeling shell 1*c*. The second modeling shell 1*b* and the third modeling shell 1*c* are fixed via the limiting ring 2 surrounding a periphery of the connecting portions 12 by which the second modeling shell 1*b* and the third modeling shell 1*c* connect with each other.

The outside of each half body 11 of the first modeling shell 1*a*, the second modeling shell 1*b*, and the third modeling shell 1*c* corresponds to the inside of the other half body 11 so that all the half bodies 11 can be positioned in the same direction. All the half bodies 11 of the first modeling shell 1*a*, the second modeling shell 1*b*, and the third modeling shell 1*c* can be positioned and receive each other in turn from large sizes to small sizes.

Figure 15:
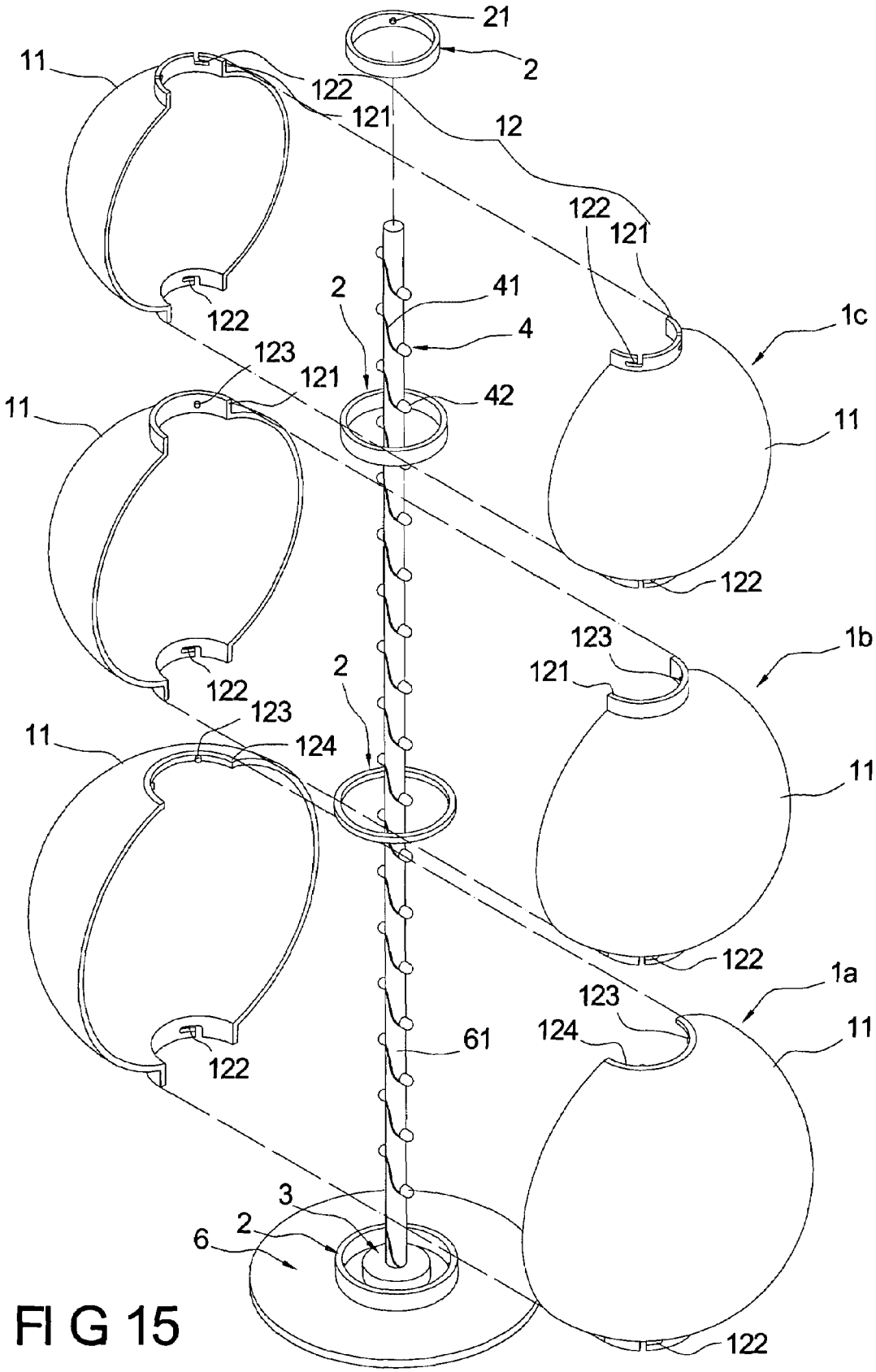
FIG. 15 is a perspective view of a fourth embodiment of the decorative structure in accordance with the present invention.

A fourth embodiment of the present invention, as shown in FIG. 15, in the above structures, includes a supporting portion 6 mounted on a bottom of one limiting ring 2. The controlling device 3 is mounted on the supporting portion 6. A fixing pole 61 extends upwards from the supporting potion 6 through the controlling device 3 and further through the modeling shell for the glowing assembly 4 spread along the fixing pole 61.

Figure 16:
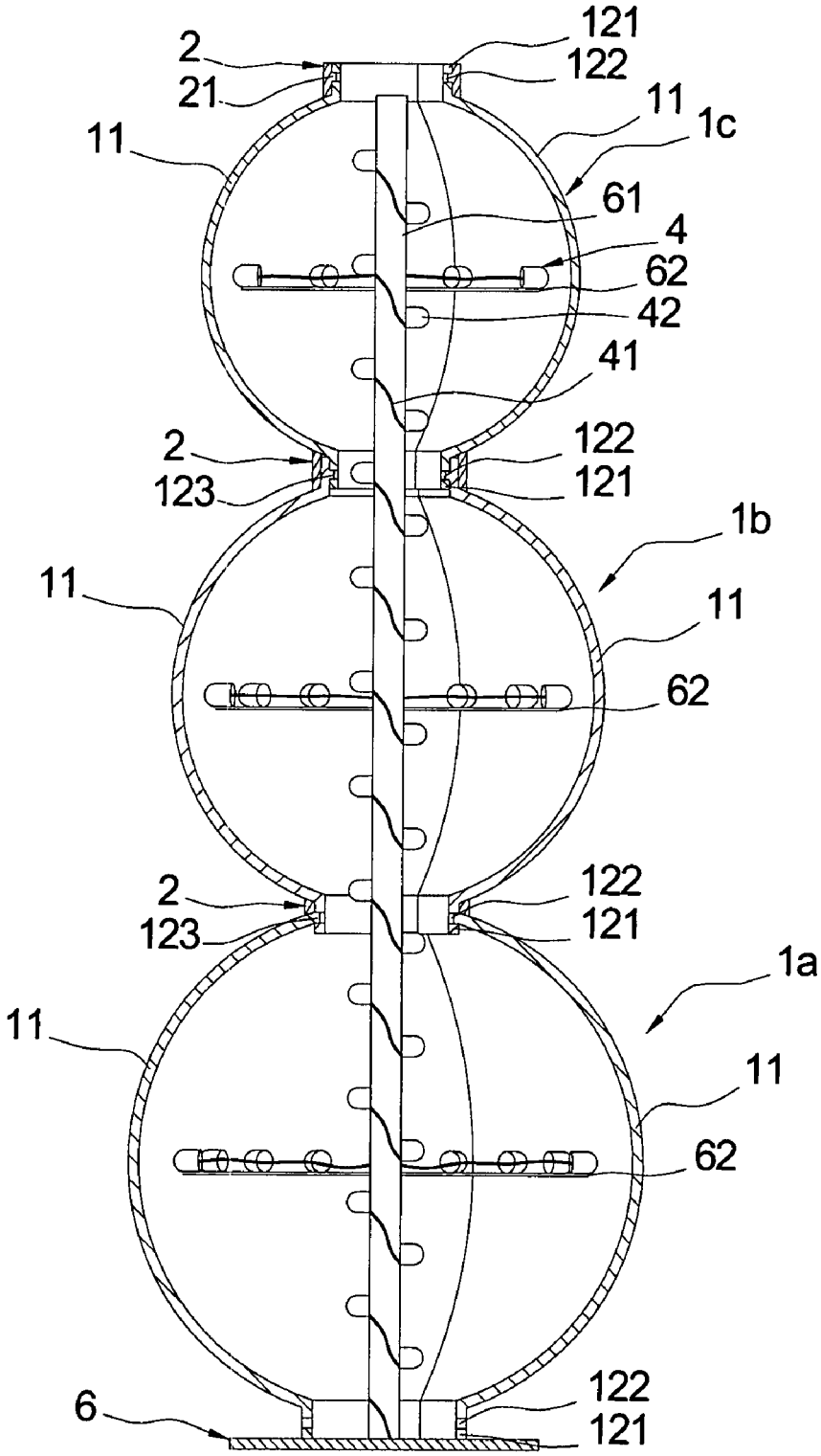
FIG. 16 is a sectional view of a fifth embodiment of the decorative structure in accordance with the present invention.

A fifth embodiment of the present invention is shown in FIG. 16. Inside the modeling shell there is a fixing pole 61. The glowing assembly 4 is disposed upon the fixing pole 61 and from a plurality of supports 62 that extend from the fixing pole 61.

A sixth embodiment of the present invention (not shown), in the above structures, includes the modeling fitting unit 5 and the glowing assembly 4 received inside one of the half bodies 11 to reduce the volume.

Accordingly, the features and efficacy of the present invention can be summed up as follows:

1. The present invention separates the modeling shells into the half bodies which are positioned with each other to reduce the actual total volume thereby to reduce packaging costs and increase total transportation quantity of per unit container to further reduce transportation costs.

2. The present invention can be assembled and separated by users in a DIY mode. In an idle state, the present invention can be separated and positioned to reduce the volume and save storage space.

3. The present invention can have different appearances. The present invention can fix more than one modeling shell via the limiting rings. The modeling shells are independent and the half bodies are positioned after separation to reduce the volume.

4. The present invention further has the modeling fitting units 5 and the glowing assembly 4 to create a better atmosphere in a decorated space.

What is disclosed above is only the preferred embodiments of the present invention and it is therefore not intended that the present invention be limited to the particular embodiments disclosed. It will be understood by those skilled in the art that various equivalent changes may be made depending on the specification and the drawings of the present invention without departing from the scope of the present invention.

What is claimed is:

1. A decorative structure, comprising:

at least one hollow modeling shell, assembled by two corresponding half bodies, wherein an outside of one half body corresponds to an inside of the other half body thereby the two half bodies are positioned in a same direction, the modeling shell having at least one connecting portion along jointed ends of the two half bodies; and at least one limiting ring, surrounding an outside of the connecting portion for supporting the modeling shell;

wherein the two half bodies are positioned in the same direction thereby the modeling shell is positioned before being assembled for reducing the volume;

wherein the two half bodies have at least one fastening hole in each of two side flanges of the connecting portion and at least two first locating blocks protrude from an inner side of the limiting ring to engage with the fastening holes thereby to fix the limiting ring.

2. The decorative structure as claimed in claim 1, further comprising a glowing assembly attaching to and spreading along the at least one hollow modeling shell, one end of the glowing assembly electrically connects to a controlling device.

3. The decorative structure as claimed in claim 2, wherein the glowing assembly has at least one flexibility wire along which a plurality of glowing elements are mounted.

4. The decorative structure as claimed in claim 1, wherein the modeling shell has two connecting portions along the jointed ends of the two half bodies.

5. The decorative structure as claimed in claim 1, comprising more than two modeling shells, a connecting portion of one modeling shell sleeved by and connected with a connecting portion of the other modeling shell.

6. The decorative structure as claimed in claim 5, wherein one connecting portion has at least one second locating block on an inner flange and the other connecting portion has at least one fastening hole in a side flange to engage with the at least one second locating block.

7. The decorative structure as claimed in claim 5, wherein an outside of each half body of the modeling shells corresponds to an inside of the other half body so that all the half bodies are positioned in the same direction.

8. The decorative structure as claimed in claim 1, wherein the connecting portion has two corresponding arc-shaped pieces disposed respectively on the jointed ends of the two half bodies of the modeling shell.

9. The decorative structure as claimed in claim 1, wherein the connecting portion has two corresponding openings arranged respectively on the jointed ends of the two half bodies of the modeling shell.

* * * * *